US006248187B1

(12) United States Patent
Asahi et al.

(10) Patent No.: US 6,248,187 B1
(45) Date of Patent: Jun. 19, 2001

(54) CORROSION RESISTING STEEL AND CORROSION RESISTING OIL WELL PIPE HAVING HIGH CORROSION RESISTANCE TO CARBON DIOXIDE GAS

(75) Inventors: Hitoshi Asahi; Koichi Nose, both of Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/402,826

(22) PCT Filed: Feb. 10, 1999

(86) PCT No.: PCT/JP99/00580

§ 371 Date: Oct. 12, 1999

§ 102(e) Date: Oct. 12, 1999

(87) PCT Pub. No.: WO99/41422

PCT Pub. Date: Aug. 19, 1999

(30) Foreign Application Priority Data

Feb. 13, 1998 (JP) ..... 10-031707
May 1, 1998 (JP) ..... 10-122053

(51) Int. Cl.[7] ..... C22C 38/18; C22C 38/22; C22C 38/40; C22C 38/26; C22C 38/28

(52) U.S. Cl. ..... 148/333; 148/334; 148/335; 420/104; 420/105; 420/109; 420/110

(58) Field of Search ..... 420/104, 105, 420/109, 110; 148/333, 334, 335

(56) References Cited

FOREIGN PATENT DOCUMENTS 56-93856 7/1981 (JP) .
57-19322 2/1982 (JP) .
10-17980 * 1/1998 (JP) .

* cited by examiner

*Primary Examiner*—Deborah Yee
(74) *Attorney, Agent, or Firm*—Kenyon & Kenyon

(57) ABSTRACT

An object of the present invention is to provide a corrosion resistant steel excellent in strength and low temperature toughness as well as resistance to corrosion by carbon dioxide and seawater, and most suitable for oil well steel pipes and line pipes for production and transportation of gas, petroleum, etc. used in the field of energy, or a steel for plants, and corrosion resistant oil well steel pipes. The corrosion resistant steel and the corrosion resistant oil well steel pipes comprise, based on weight, up to 0.30% of C, up to 1.0% of Si, 0.2 to 2.0% of Mn, 2.1 to less than 5.0% of Cr, up to 0.03% of P, up to 0.02% of S, up to 0.10% of Al, up to 0.015% of N, optionally containing Cu, Ni, Mo, Ti, Nb and B, and the balance of Fe and unavoidable impurities, and have a martensitic structure as their metallic structure.

12 Claims, 1 Drawing Sheet

CORROSION RESISTING STEEL AND CORROSION RESISTING OIL WELL PIPE HAVING HIGH CORROSION RESISTANCE TO CARBON DIOXIDE GAS

TECHNICAL FIELD

The present invention relates to a corrosion resistant steel excellent in resistance to corrosion by carbon dioxide, most suitable for oil well steel pipes and line pipes for production and transportation of gas, petroleum, etc. used in the field of energy, or a steel for plants, and corrosion resistant oil well steel pipes.

BACKGROUND ART

A steel material such as a carbon steel or a low alloy steel is used for oil well steel pipes, line pipes, etc. for the production and transportation of petroleum, gas, and the like. For highly corrosive petroleum and gas wells, a carbon steel, or the like material is used while corrosion inhibitors are added to petroleum, etc., or a stainless steel material such as 13% Cr steel is used as the material itself. A sufficient service period of the oil well steel pipes and line pipes has thus been ensured.

However, use of a stainless steel for oil wells, etc., the life of which is short is overly expensive in terms of cost efficiency because the stainless steel is costly. On the other hand, there is a trend towards avoiding the use of corrosion inhibitors because of their adverse effects on the environment. Accordingly, the development of steel materials capable of ensuring the resistance to corrosion to a certain degree has been expected. In order to answer the expectations, a steel containing 0.5 to 5% of Cr is proposed in Japanese Unexamined Patent Publication (Kokai) No. 57-5846. However, the patent publication merely discloses in examples inventive steels containing from 0.5 to 2.1% of Cr.

Furthermore, when a steel containing Cr is used, the steel must have a good balance between the strength and the low temperature toughness. Although the balance therebetween is greatly influenced by the metallic structure, Japanese Unexamined Patent Publication (Kokai) No. 57-5846 defines no metallic structure of the steel material.

DISCLOSURE OF INVENTION

An object of the present invention is to provide a corrosion resistant steel excellent in resistance to corrosion by carbon dioxide and seawater, most suitable for oil well steel pipes and line pipes for production and transportation of gas, petroleum, etc. used in the field of energy, or a steel for plants, and excellent in strength and low temperature toughness, and corrosion resistant oil well steel pipes.

The present invention is characterized by that the Cr content and the metal structure most suitable for a corrosion resistant steel excellent in resistance to corrosion by carbon dioxide are defined, and provides corrosion resistant steels and corrosion resistant oil well steel pipes as disclosed in (1) to (5) below.

(1) A corrosion resistant steel excellent in resistance to corrosion by carbon dioxide, comprising, based on weight, up to 0.30% of C, up to 1.0% of Si, 0.2 to 2.0% of Mn, 2.1 to less than 5.0% of Cr, up to 0.03% of P, up to 0.02% of S, up to 0.10% of Al, up to 0.015% of N and the balance of Fe and unavoidable impurities, and having a martensitic structure.

(2) A corrosion resistant steel excellent in resistance to corrosion by carbon dioxide, comprising, based on weight, up to 0.30% of C, up to 1.0% of Si, 0.2 to 2.0% of Mn, 2.1 to less than 5.0% of Cr, up to 0.03% of P, up to 0.02% of S, up to 0.10% of Al, up to 0.015% of N, one or more elements selected from Cu, Ni and Mo in an amount of up to 1% and the balance of Fe and unavoidable impurities, and having a martensitic structure.

(3) A corrosion resistant steel excellent in resistance to corrosion by carbon dioxide, comprising, based on weight, up to 0.30% of C, up to 1.0% of Si, 0.2 to 2.0% of Mn, 2.1 to less than 5.0% of Cr, up to 0.03% of P, up to 0.02% of S, up to 0.10% of Al, up to 0.015% of N, one or more of Cu, Ni and Mo in an amount of up to 1%, one or more of 0.001 to 0.2% of Ti, 0.01 to 0.5% of Nb and 0.0005 to 0.003% of B and the balance of Fe and unavoidable impurities, and having a martensitic structure.

(4) The corrosion resistant steel excellent in resistance to corrosion by carbon dioxide according to any one of (1) to (3), wherein the steel has a yield strength of at least 550 MPa.

(5) A corrosion resistant oil well steel pipe characterized by that the oil well steel pipe is produced from the corrosion resistant steel excellent in resistance to corrosion by carbon dioxide according to any one of (1) to (4).

The martensitic structure herein designates an as quench-hardened martensitic structure or a tempered martensitic structure. The martensitic structure is usually tempered to increase the low temperature toughness and give a material having a desired range of strength.

BEST MODE FOR CARRYING OUT THE INVENTION

The action and effect of each of the steel components in the steel of the present invention, and reasons for restricting the content will be explained below. All the percentages expressed below are based on weight.

C: C is an element effective for increasing the strength of the steel. In particular, C is an element essential in obtaining a martensitic structure. In general, when the C content of a steel increases, the low temperature toughness and resistance to corrosion of the steel are lowered. For a steel of martensitic structure, the lowering degree is small when the C content is up to 0.30%. However, when the C content exceeds 0.30%, a large amount of carbide is formed at the grain boundaries in the step of tempering the steel to deteriorate the low temperature toughness and lower the resistance to corrosion. Accordingly the C content is defined to be up to 0.30%. When the steel is required to have a particularly good balance between the low temperature toughness and the resistance to corrosion, the C content is desirably up to 0.25%. Since the steel is required to have good weldability when used for line pipes, plant tubes, etc., the C content is desirably defined to be up to 0.10%. When the steel is used for oil well steel pipes, the steel is not required to have weldability, the steel having a higher C content can have a martensitic structure more easily. However, a desirable C content range is from 0.10 to 0.25%.

Si: Si is added for the purpose of deoxidation. However, the low temperature toughness is deteriorated when the Si content exceeds 1.0%. Accordingly, the upper limit of the Si content is defined to be 1.0%. The steel can be sufficiently deoxidized with Al and Ti, and Si is not necessarily required to be added.

Mn: Mn is added because Mn improves the low temperature toughness of the steel and because Mn has the effect of improving the quench hardenability for obtaining a martensitic structure. However, the effect is not sufficient when the Mn content is less than 0.2%, and the toughness of the steel is lowered contrary to the intention when the Mn content exceeds 2.0%. The Mn content is therefore defined to be from 0.2 to 2.0%.

Figure 1:
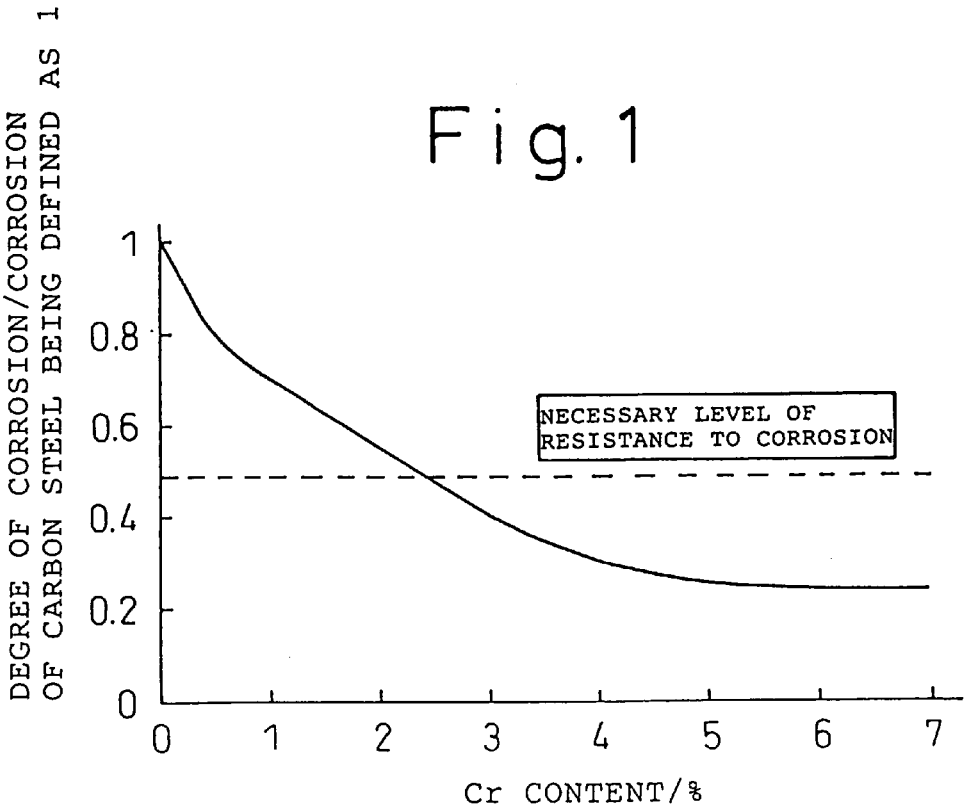
FIG. 1 is a graph showing the results of corrosion tests in a deep ground water-simulated solution at 80° C. having a chlorine concentration of 5% at a carbon dioxide gas pressure of 0.3 MPa.
Figure 2:
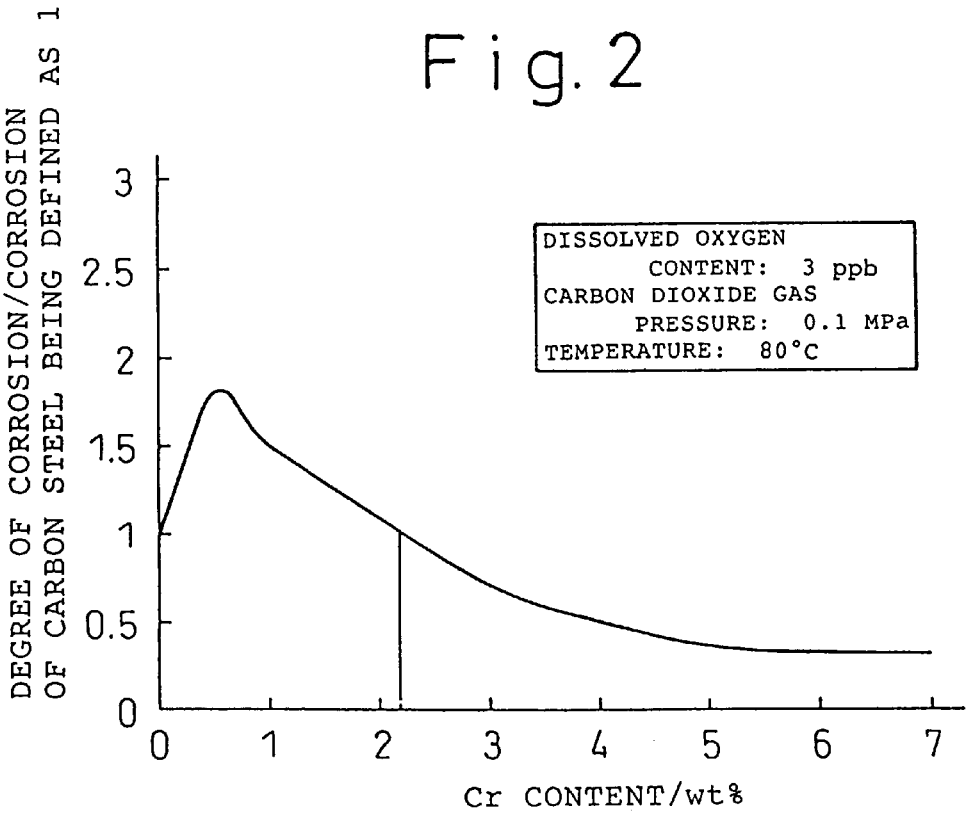
FIG. 2 is a graph showing the results of corrosion tests in a deep ground water-simulating solution at 80° C. at a flow rate of 1 m/sec having a dissolved oxygen content of 3 ppb at a carbon dioxide gas pressure of 0.1 MPa.

Cr: Cr is an element effective for decreasing corrosion by carbon dioxide and seawater. However, when the Cr content is less than 2.1%, the steel cannot have sufficient resistance to corrosion under the following typical conditions in the field of applications in the present invention: a temperature of 80° C., a pressure of about 0.1 to 0.3 MPa, and an environment where seawater flows. Moreover, when the Cr content is at least 5.0%, the steel cannot have resistance to corrosion which balances the Cr content. FIG. 1 shows the results of corrosion tests in a deep ground water-simulating solution containing 5% of chlorine at 80° C. at a carbon dioxide pressure of 0.3 MPa. A necessary level of resistance to corrosion can be obtained when the Cr content is at least 2.1%, particularly when it is at least 2.5%. Furthermore, the present inventors have found in their research that when the dissolved oxygen content is as very low as up to 5 ppb in a solution, a steel containing Cr in an amount of 0.5 to less than 2.1% is likely to be corroded more than a steel containing no Cr as shown in FIG. 2, and that only when the steel has a Cr content of at least 2.1%, the steel shows excellent resistance to corrosion without depending on the environment. Accordingly, the Cr content is defined to be from 2.1 to less than 5.0%. When the steel is particularly required to have excellent corrosion resistance, the Cr content is desirably defined to be at least 2.5%.

P: P is present in the steel as an impurity element, and embrittles the steel. Accordingly, the upper limit of the P content is defined to be 0.03%.

S: S is also present in the steel as an impurity element, embrittles the steel, and exerts adverse effects on the resistance to corrosion. Accordingly, the upper limit of the S content is defined to be 0.02%.

Al: Al is added for the purpose of deoxidation. However, when the Al content exceeds 0.10%, the cleanliness of the steel is lowered to cause deterioration of the low temperature toughness. Accordingly, the Al content is defined to be up to 0.10%. Ti or Si can also deoxidize the steel, and addition of Al is not always required.

N: N remains in the steel as an unremovable element. However, when the N content exceeds 0.015%, the low temperature toughness of the steel is markedly deteriorated. Accordingly, the upper limit of the N content is defined to be 0.015%.

Furthermore, when the steel is allowed to contain one or more of Cu, Ni and Mo in an amount of up to 1%, addition of Cr can further increase the stability of a stabilized corrosion resistant coating. Because there is no difference between addition of any one of these elements and composite addition of thereof, one or more of these elements can be added in accordance with necessary resistance to corrosion.

Ti, Nb, B: These elements are added for the purpose of increasing the strength of the steel. When these elements are added in amounts less than the lower limits of the addition amounts, respectively, the effect of increasing the strength is poor. Conversely, when these elements are added in amounts exceeding the upper limits of the addition amounts, respectively, the toughness of the steel is reduced. Accordingly, the contents of these elements are defined to be as follows: Ti: 0.001 to 0.2%, Nb: 0.01 to 0.5%, and B: 0.0005 to 0.003%. Because there is no difference between addition of any one of these elements and composite addition of these elements, one or at least two of these elements can be added in accordance with a necessary strength.

The steel of the invention having such a chemical composition as mentioned above can be made to have a necessary balance between the strength and the low temperature toughness by adjusting the metallic structure by heat treatment at the time of its use. In particular, an excellent balance between the strength and the low temperature toughness can be obtained by transforming the metallic structure into a martensitic one. In particular, for a high strength steel having a yield strength of at least 550 MPa, it is essential that the steel be transformed into a martensitic structure for the purpose of ensuring a good low temperature toughness.

In view of the resistance to corrosion of the steel, the following can be concluded. A martensitic structure partly mixed with ferrite, or a ferritic-pearlitic structure produces microcells due to a corrosion reaction at a part between martensite and ferrite, or ferrite and pearlite, which reaction is caused by microscopic nonuniformity of the structure, and as a result the corrosion reaction rate is accelerated. However, when the steel has a martensite single phase, the microcells are not formed because the structure is uniform, and the structure is excellent in resistance to corrosion compared with other structures.

The martensitic structure can generally be obtained by rapidly cooling the steel immediately after hot rolling or after reheating the hot-rolled steel. The steel is considered to be capable of being transformed into a martensitic structure by water cooling when the C content of the steel is up to 1.5%, or by accelerated cooling when the C content exceeds 1.5%. However, the C content condition somewhat varies depending on the thickness of the steel material and cooling conditions.

The steel of the invention excellent in resistance to corrosion, strength and low temperature toughness as explained above can be used for various instruments and apparatuses which are required to have resistance to corrosion by carbon dioxide. In particular, the steel of the present invention can be used for corrosion resistant oil well steel pipes in the field of oil well steel pipes which requires the steel to have a high strength as a prerequisite, in oil wells where conventional oil well carbon steel pipes cannot maintain their life sufficiently due to a high partial pressure of carbon dioxide.

EXAMPLES

Table 1 shows the chemical compositions, metallic structures and mechanical properties of steels and the results of corrosion tests. The metallic structures are expressed by the following abbreviated marks: a martensitic single phase: M, a martensitic structure mixed with ferrite: M—F, and a ferritic-pearlitic structure: FP. The low temperature toughness of a steel was evaluated by measuring energy absorbed in a Charpy impact test at −30° C. The evaluation results were expressed by the following criteria: "very excellent" represented by the mark ⊕ when the absorbed energy was at least 120 J; "poor" represented by the mark x when the absorbed energy was 50 J; and "good" when the absorbed energy was between 50 and 120 J. The resistance to corrosion of a steel was evaluated by a corrosion test in a deep ground water-simulated solution containing 5% of chlorine at a carbon dioxide gas pressure of 0.3 MPa. The corrosion amount of a carbon steel was defined to be 1, and the results of the corrosion test were expressed by the following criteria: "⊕" when the corrosion amount was up to 0.5; "o" when the corrosion amount was from 0.5 to 0.7; and "x" when the corrosion amount was greater than 0.7. Steel Nos. 1 to 18 were steels of invention, which had a martensitic structure formed by quench hardening, and the strength of which was adjusted by tempering. Steel Nos. 19 to 22 were comparative steels having a chemical composition outside the scope of the present invention, or having no single phase martensitic structure. Although each of the steels of invention had a high strength of at least 550 MPa, it showed good toughness and good resistance to corrosion. The comparative steels had either a poor low temperature toughness or an insufficient resistance to corrosion. It is therefore evident that the steels of invention are superior to the comparative steels.

Furthermore, steels having chemical compositions of Nos. 7, 16, 17 and 18, respectively in Table 1 were seamless-rolled to form pipes. The pipes thus obtained were quench-hardened and tempered by the same procedure as employed in Table 1 to give oil well steel pipes of L-80 grade in API Standard. As a result of evaluating test pieces for corrosion test taken from the oil well steel pipes, all the test pieces showed an excellent resistance to corrosion, namely evaluation of "⊕". The steels therefore showed that they had a long life when used for oil well steel pipes.

TABLE 1

Examples

| No. | Classification | Chemical composition (wt %) C | Si | P | S | Mn | Cr | Al | N | Cu | Ni | Mo | Ti | Nb | B | Structure | YS/MPa | TS/MPa | Toughness | Resistance to corrosion |
|---|---|---|---|---|---|---|---|---|---|---|---|---|---|---|---|---|---|---|---|---|
| 1 | Inventive steel | 0.02 | 0.12 | 0.013 | 0.004 | 0.35 | 3.20 | 0.019 | 0.0032 | — | — | — | — | — | — | M | 580 | 670 | ⊙ | ⊙ |
| 2 | Inventive steel | 0.03 | 0.10 | 0.016 | 0.004 | 0.35 | 2.70 | 0.022 | 0.0038 | — | — | — | — | — | — | M | 592 | 683 | ⊙ | ⊙ |
| 3 | Inventive steel | 0.05 | 0.35 | 0.013 | 0.004 | 0.35 | 2.90 | 0.019 | 0.0065 | — | — | — | — | — | — | M | 620 | 701 | ⊙ | ⊙ |
| 4 | Inventive steel | 0.08 | 0.10 | 0.013 | 0.008 | 0.35 | 3.50 | 0.019 | 0.0040 | — | — | — | — | — | — | M | 617 | 754 | ⊙ | ⊙ |
| 5 | Inventive steel | 0.27 | 0.25 | 0.010 | 0.004 | 0.80 | 2.90 | 0.019 | 0.0043 | — | — | — | — | — | — | M | 623 | 715 | ⊙ | ⊙ |
| 6 | Inventive steel | 0.03 | 0.12 | 0.013 | 0.004 | 1.20 | 2.50 | 0.037 | 0.0028 | — | — | — | — | — | — | M | 621 | 725 | ⊙ | ⊙ |
| 7 | Inventive steel | 0.15 | 0.32 | 0.006 | 0.001 | 0.35 | 3.00 | 0.017 | 0.0045 | — | — | — | — | — | — | M | 605 | 712 | ⊙ | ⊙ |
| 8 | Inventive steel | 0.10 | 0.12 | 0.013 | 0.004 | 0.35 | 4.01 | 0.017 | 0.0039 | — | — | — | — | — | — | M | 608 | 715 | ⊙ | ⊙ |
| 9 | Inventive steel | 0.03 | 0.14 | 0.013 | 0.002 | 0.35 | 4.98 | 0.017 | 0.0058 | — | — | — | — | — | — | M | 608 | 721 | ⊙ | ⊙ |
| 10 | Inventive steel | 0.03 | 0.27 | 0.018 | 0.004 | 0.35 | 2.50 | 0.047 | 0.0039 | — | — | 0.7 | — | — | — | M | 590 | 689 | ⊙ | ⊙ |
| 11 | Inventive steel | 0.02 | 0.08 | 0.012 | 0.003 | 0.35 | 2.70 | 0.020 | 0.0030 | 0.6 | 0.4 | — | — | — | — | M | 615 | 708 | ⊙ | ⊙ |
| 12 | Inventive steel | 0.18 | 0.18 | 0.012 | 0.007 | 0.35 | 2.50 | 0.020 | 0.0032 | 0.8 | 0.5 | 0.8 | — | — | — | M | 607 | 712 | ⊙ | ⊙ |
| 13 | Inventive steel | 0.02 | 0.29 | 0.017 | 0.003 | 0.35 | 4.50 | 0.002 | 0.0035 | — | — | — | 0.2 | — | — | M | 597 | 714 | ⊙ | ⊙ |
| 14 | Inventive steel | 0.02 | 0.07 | 0.012 | 0.003 | 0.35 | 2.50 | 0.022 | 0.0040 | 0.7 | — | — | — | 0.8 | — | M | 628 | 719 | ⊙ | ⊙ |
| 15 | Inventive steel | 0.12 | 0.12 | 0.009 | 0.004 | 0.34 | 2.90 | 0.034 | 0.0022 | — | 0.9 | — | — | — | 0.001 | M | 601 | 699 | ⊙ | ⊙ |
| 16 | Inventive steel | 0.02 | 0.14 | 0.009 | 0.004 | 0.34 | 2.90 | 0.018 | 0.0037 | — | — | — | 0.02 | — | 0.001 | M | 596 | 687 | ⊙ | ⊙ |
| 17 | Inventive steel | 0.06 | 0.43 | 0.009 | 0.004 | 0.34 | 2.90 | 0.020 | 0.0042 | 0.5 | 0.2 | — | 0.02 | — | 0.001 | M | 599 | 701 | ⊙ | ⊙ |
| 18 | Inventive steel | 0.16 | 0.12 | 0.009 | 0.004 | 0.34 | 2.90 | 0.021 | 0.0028 | 0.8 | 0.4 | 0.5 | 0.02 | 0.4 | 0.001 | M | 630 | 725 | ⊙ | ⊙ |
| 19 | Comparative steel | 0.03 | 0.42 | 0.013 | 0.003 | 1.90 | 2.00 | 0.059 | 0.0036 | — | — | — | — | — | — | M-F | 570 | 622 | x | x |
| 20 | Comparative steel | 0.15 | 0.28 | 0.010 | 0.008 | 1.10 | 3.11 | 0.019 | 0.0045 | | | — | — | — | — | M-F | 568 | 720 | x | ○ |
| 21 | Comparative steel | 0.15 | 0.23 | 0.016 | 0.005 | 0.50 | 4.90 | 0.020 | 0.0029 | — | — | — | — | — | — | FP | 422 | 632 | x | ○ |
| 22 | Comparative steel | 0.35 | 0.50 | 0.013 | 0.005 | 0.50 | 3.00 | 0.020 | 0.0033 | — | — | — | | — | — | FP | 433 | 678 | x | ○ |

Industrial Applicability

The present invention provides a corrosion resistant steel excellent in resistance to corrosion by carbon dioxide and having a good balance between the strength and the low temperature toughness. The present invention therefore greatly contributes to efficiently designing instruments and apparatuses in the energy industry.

What is claimed is:

1. A corrosion resistant steel excellent in resistance to corrosion by carbon dioxide, comprising, based on weight, up to 0.30% of C, up to 1.0% of Si, 0.2 to 2.0% of Mn, 2.1 to less than 5.0% of Cr, up to 0.03% of P, up to 0.02% of S, up to 0.10% of Al, up to 0.015% of N and the balance of Fe and unavoidable impurities, and having a martensitic structure.

2. A corrosion resistant steel excellent in resistance to corrosion by carbon dioxide, comprising, based on weight, up to 0.30% of C, up to 1.0% of Si, 0.2 to 2.0% of Mn, 2.1 to less than 5.0% of Cr, up to 0.03% of P, up to 0.02% of S, up to 0.10% of Al, up to 0.015% of N, one or more elements selected from Cu, Ni and Mo in an amount of up to 1% each and the balance of Fe and unavoidable impurities, and having a martensitic structure.

3. A corrosion resistant steel excellent in resistance to corrosion by carbon dioxide, comprising, based on weight, up to 0.30% of C, up to 1.0% of Si, 0.2 to 2.0% of Mn, 2.1 to less than 5.0% of Cr, up to 0.03% of P, up to 0.02% of S, up to 0.10% of Al, up to 0.015% of N, one or more of Cu, Ni and Mo in an amount of up to 1%, one or more of 0.001 to 0.2% of Ti, 0.01 to 0.5% of Nb and 0.0005 to 0.003% of B and the balance of Fe and unavoidable impurities, and having a martensitic structure.

4. The corrosion resistant steel excellent in resistance to corrosion by carbon dioxide according to claim 1, wherein the steel has a yield strength of at least 550 MPa.

5. A corrosion resistant oil well steel pipe characterized by that the oil well steel pipe is produced from the corrosion resistant steel excellent in resistance to corrosion by carbon dioxide according to claim 1.

6. The corrosion resistant steel excellent in resistance to corrosion by carbon dioxide according to claim 2, wherein the steel has a yield strength of at least 550 MPa.

7. The corrosion resistant steel excellent in resistance to corrosion by carbon dioxide according to claim 3, wherein the steel has a yield strength of at least 550 MPa.

8. A corrosion resistant oil well steel pipe characterized by that the oil well steel pipe is produced from the corrosion resistant steel excellent in resistance to corrosion by carbon dioxide according to claim 2.

9. A corrosion resistant oil well steel pipe characterized by that the oil well steel pipe is produced from the corrosion resistant steel excellent in resistance to corrosion by carbon dioxide according to claim 3.

10. A corrosion resistant oil well steel pipe characterized in that the oil well steel pipe is produced from the corrosion resistant steel excellent in resistance to corrosion by carbon dioxide according to claim 4.

11. A corrosion resistant oil well steel pipe characterized in that the oil well steel pipe is produced from the corrosion resistant steel excellent in resistance to corrosion by carbon dioxide according to claim 6.

12. A corrosion resistant oil well steel pipe characterized in that the oil well steel pipe is produced from the corrosion resistant steel excellent in resistance to corrosion by carbon dioxide according to claim 7.

* * * * *